United States Patent [19]

Lazzari

[11] Patent Number: 4,575,031

[45] Date of Patent: Mar. 11, 1986

[54] DEVICE FOR DETECTING THE UNBALANCE BETWEEN THE TWO FRACTIONS OF THE RETURN TRACTION CURRENT IN THE RAILS OF A RAILROAD TRACK

[75] Inventor: Antonio Lazzari, Bologna, Italy

[73] Assignee: Sasib S.p.A., Bologna, Italy

[21] Appl. No.: 554,322

[22] Filed: Nov. 22, 1983

[30] Foreign Application Priority Data

Nov. 23, 1982 [IT] Italy ..... 12674 A/82

[51] Int. Cl.[4] ..... B61L 21/00

[52] U.S. Cl. ..... 246/34 R; 246/42; 246/43; 246/61

[58] Field of Search ..... 246/10, 34 R, 34 CT, 246/35, 36, 42, 43, 61; 104/295, 297; 191/3; 307/148

[56] References Cited

U.S. PATENT DOCUMENTS

| | | | |
|---|---|---|---|
| 1,070,130 | 8/1913 | Hobson et al. | 246/61 |
| 1,094,894 | 4/1914 | Hawkins | 246/36 |
| 1,304,295 | 5/1919 | Fortescue | 246/35 |
| 1,948,197 | 2/1934 | Baughman et al. | 246/63 |
| 2,098,833 | 11/1937 | Peter | 246/42 X |
| 2,155,343 | 4/1939 | Bonanno | 104/297 |
| 2,966,581 | 12/1960 | Ehni | 246/35 |
| 2,993,172 | 7/1961 | Karlicek . | |
| 3,450,873 | 6/1969 | Whitten | 246/34 CT |
| 3,450,875 | 6/1969 | Whitten et al. | 246/34 CT |
| 3,855,412 | 12/1974 | Maddux | 307/148 X |
| 4,066,229 | 1/1978 | Clark | 246/34 CT |
| 4,155,038 | 5/1979 | Merklinger et al. . | |

*Primary Examiner*—Randolph A. Reese
*Assistant Examiner*—Edward M. Wacyra
*Attorney, Agent, or Firm*—Spencer & Frank

[57] ABSTRACT

A device for detecting the unbalance $\Delta i$ between the two fractions of the return traction current flowing in the two rails of a railroad track, in the presence of a signalling current in the respective track circuit, includes a linear combination circuit (3) that receives two signals ($i_1$ and $i_2$) which are proportional to the two currents actually present in the two rails and obtains both the difference ($i_1-i_2$) and the sum ($i_1+i_2$) thereof. A demodulating circuit (4), fed with the difference signal, takes from it the modulating signal of the signalling current and feeds it to a sample generator circuit (5), which generates a sample function M(t). The sample function is supplied to two successive sampling circuits (106 and 206), one of which also receives the difference signal and produces a sampled difference signal $M(i_1-i_2)$, while the other also receives the sum signal and produces a sampled sum signal $M(i_1+i_2)$. Four filtering-rectifying parallel circuits (107,207,307,407) receive the sum and difference signals and the sampled sum and difference signals, and supply the mean values $Fo[|i_1-i_2|]$, $Fo[M|i_1-i_2|]$, $Fo[|i_1+i_2|]$ and $Fo[M|i_1+i_2|]$. A function generator circuit (8) furnishes an output signal corresponding to $$(i_1 + i_2)\frac{Fo[M|i_1 - i_2|]}{Fo[M|i_1 + i_2|]},$$

which is supplied to a switching circuit (11) along with the sum and difference signals. The switching circuit is controlled so as to give, at the output thereof, one of the signals $$(i_1 + i_2)\frac{Fo[M|i_1 - i_2|]}{Fo[M|i_1 + i_2|]},$$

4 Claims, 1 Drawing Figure

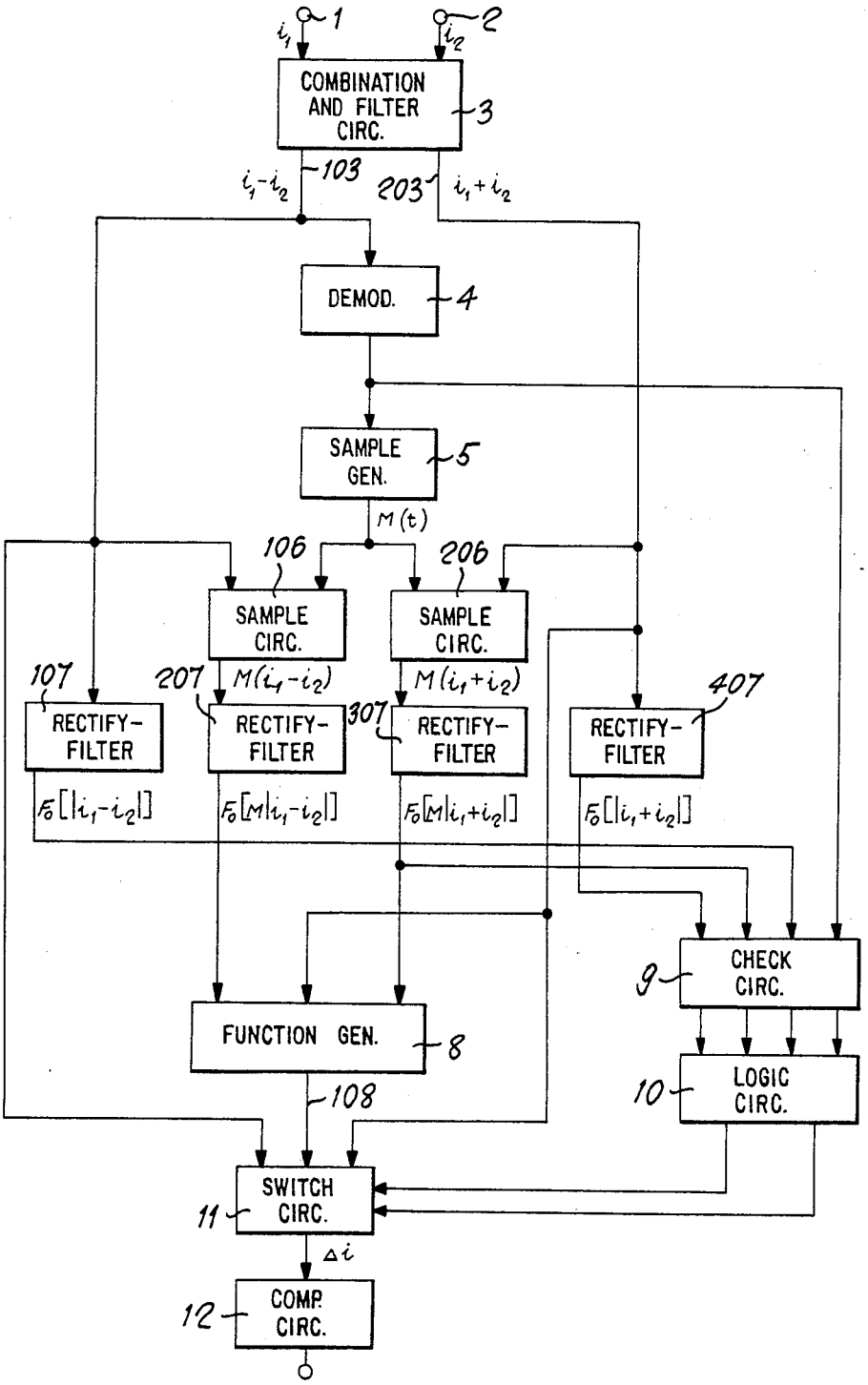
1
2
$i_1$
$i_2$
COMBINATION AND FILTER CIRC.
3
103
203
$i_1-i_2$
$i_1+i_2$
DEMOD.
4
SAMPLE GEN.
5
M(t)
106
206
SAMPLE CIRC.
SAMPLE CIRC.
107
207
307
407
$M(i_1-i_2)$
$M(i_1+i_2)$
RECTIFY-FILTER
RECTIFY-FILTER
RECTIFY-FILTER
RECTIFY-FILTER
$F_0[|i_1-i_2|]$
$F_0[M|i_1-i_2|]$
$F_0[M|i_1+i_2|]$
$F_0[|i_1+i_2|]$
9
CHECK CIRC.
FUNCTION GEN.
8
10
LOGIC CIRC.
108
SWITCH CIRC.
11
Δi
12
COMP. CIRC.

DEVICE FOR DETECTING THE UNBALANCE BETWEEN THE TWO FRACTIONS OF THE RETURN TRACTION CURRENT IN THE RAILS OF A RAILROAD TRACK

BACKGROUND AND SUMMARY OF THE INVENTION

This invention relates to a device for detecting the unbalance between two fractions of the return traction current flowing in the two rails of a railroad track, in the presence of a signalling current in the respective track circuit.

It is known that a railroad electric locomotive is fed with current from an external generator (usually from a feeding substation) through an overhead wire, and said current is returned through the pair of rails of the railroad track. Usually, the return traction current is divided into two roughly equal fractions between the two rails. In case of electrical asymmetry between the two rails, however, the corresponding fractions of the return traction current are different from each other. The difference between the two fractions of the return traction current in the two rails of a railroad track is called "unbalance" and can cause disturbances in the normal signalling made through the track circuits, particularly when the traction current, in addition to the continuous component, contains spectral components with frequencies, for example, between 30 and 70 Hz and the signalling current in the track circuit is also an alternating current, e.g. a 50 Hz current which is amplitude-modulated with signals having, for example, frequencies of 1.25–2–3–4.5 Hz.

To detect the value of unbalance $\Delta i$ between the two fractions of the return traction current in the two track rails, the invention is based on the recognition that—in the presence of a signalling current in the track—said unbalance $\Delta i$ is proportional to the sum $(i_1+i_2)$ of the currents $i_1$ and $i_2$ actually present in the rails and formed each by a component of the traction current and by a component of the track signalling current, said proportionality corresponding to a coefficient which is equal to the ratio between the mean values of the difference $(i_1-i_2)$ and of the sum $(i_1+i_2)$ of said currents actually present in the two rails, said difference and said sum being multiplied each by a given function M(t).

The above is expressed by the formula:

$$\Delta i = (i_1 + i_2)\frac{Fo[M|i_1 - i_2|]}{Fo[M|i_1 + i_2|]} \quad (1)$$

wherein:

$\Delta i$ = unbalance between the two fractions of the return traction current in the two track rails;

$i_1$, $i_2$ = currents actually present in the two track rails and formed each by the track signalling current and by a fraction of the total current of traction.

The above formula is not valid if $$Fo[M|i_1+i_2|]=0$$

In this instance (i.e., the denominator in formula 1 is zero), the following two conditions occur:

(1) If the mean value of the sum of actual currents $i_1$ and $i_2$ flowing in the two rails is higher than the mean value of the difference between these currents, namely if $Fo[|i_1+i_2|]>Fo[|i_1-i_2|]$, then:

$$\Delta i=i_1-i_2 \quad (2)$$

(2) However, if the mean value of the sum of actual currents $i_1$ and $i_2$ flowing in the two rails is lower than the mean value of the difference between said currents, namely if $Fo[|i_1+i_2|]<Fo[|i_1-i_2|]$, then:

$$\Delta i=i_1+i_2 \quad (3)$$

Finally, when the two currents $i_1$ and $i_2$ actually present in the two rails are such as to prevent the recognition of the signalling current therein, due to the unbalance $\Delta i$ of the two respective fractions of the return traction current, the formula (2) should be valid.

In conclusion, the amount of unbalance $\Delta i$ between the two fractions of the return traction current in the two track rails may be determined, depending upon the circumstances, by one of the three formulae (1), (2), or (3).

BRIEF DESCRIPTION OF THE DRAWING

On the basis of said recognition, the invention provides a device which is shown diagrammatically in the single FIGURE of the accompanying drawing and which may be inserted in the on-ground installation at the receiving end of the track circuit, without requiring any modification at the transmitting end thereof. On the other end, the device according to the invention may also be mounted on a locomotive and fulfil the same function on the signal repeaters.

DESCRIPTION OF THE PREFERRED EMBODIMENT

With reference to the drawing, the numerals 1 and 2 indicate two current taps supplying the actual electrical currents $i_1$ and $i_2$ present in the two rails of an electrified railroad track comprising track circuits. Said two currents $i_1$ and $i_2$ comprise each a signalling current pertaining to the respective track circuit, which is positive to one of the rails and negative to the other rail, and a fraction of the return traction electric current which is divided between the two rails.

In the illustrated embodiment, it is assumed that the fractions of the return traction currents in the two rails have frequencies in the band between 30 and 70 Hz, and the signalling current is the typical current in the track circuits used in railroad installations and, therefore, is formed by a 50 Hz alternating current which is aplitude-modulated with signals having frequencies of 1.25–2–3 and 4.5 Hz.

Said currents $i_1$ and $i_2$ actually in the rails are fed to a linear combination and bandpass filtering circuit 3 which eliminates the components beyond the 30 to 70 Hz frequency band from the currents $i_1$ and $i_2$ and feeds the difference $i_1-i_2$ to one output 103 and the sum $i_1+i_2$ to the other output 203.

The difference signal $i_1-i_2$ is applied to a demodulating circuit 4 which processes said signal and takes from it the modulating signal of the signalling current that is typical for track circuits (with frequency of 1.25–2–3–4.5 Hz). The signal processed by the demodulating circuit 4 is supplied to the sample generator circuit 5 which processes the modulating signal of the signalling current and supplies the sample function M(t).

The device also comprises two sampling circuits 106 and 206 parallelly connected to each other, both receiving the sample function M(t) supplied by the sample generator circuit 5. The sampling circuit 106 also receives, from the output 103 of said circuit 3, the signal corresponding to the difference $i_1-i_2$, processes said signal by means of the sample function M(t) and emits an output signal $M(i_1-i_2)$. Similarly, the sampling circuit 206 receives, from the output 203 of said circuit 3, the signal corresponding to the sum $(i_1+i_2)$, processes said signal by means of the sample function M(t) and emits a signal $M(i_1+i_2)$.

The device also comprises four rectifying-filtering circuits 107,207,307,407 parallelly connected to each other. The circuit 107 receives the difference signal $i_1-i_2$ directly from the output 103 of circuit 3 and emits the mean value of the rectified signal of said difference, corresponding to $Fo[|i_1-i_2|]$. The circuit 207 receives the signal $M(i_1-i_2)$ from the sampling circuit 106 and emits the mean value of the rectified signal of the sampled difference, corresponding to $Fo[M|i_1-i_2|]$. The circuit 307 receives the signal $M(i_1+i_2)$ from the sampling circuit 206 and emits the mean value of the rectified signal of the sampled sum $Fo[M|i_1+i_2|]$. The last rectifying-filtering circuit 407 receives the signal corresponding to the sum $i_1+i_2$ directly from the output 203 of the circuit 3 and emits the mean value of the rectified sum signal, corresponding to $Fo[|i_1+i_2|]$.

The signals $Fo[M|i_1-i_2|]$, $Fo[M|i_1+i_2|]$ supplied by the rectifying-filtering circuits 207 and 307, and the signal corresponding to the sum $i_1+i_2$ at the output 203 of the circuit 3 are applied to the function generator circuit 8, the output 108 of which complies with the expression $$(i_1+i_2)\frac{Fo[M|i_1-i_2|]}{Fo[M|i_1+i_2|]} \qquad (1)$$

The device also comprises a check circuit 9 which receives the following signals:

$Fo[|i_1+i_2|]$ from the rectifying-filtering circuit 407, $Fo[M|i_1+i_2|]$ from the rectifying-filtering circuit 307, $Fo[|i_1-i_2|]$ from the rectifying-filtering circuit 107, and Modulating signal of the signalling circuit from the demodulating circuit 4.

The check circuit 9 effects the following tests on the received signals:

it checks whether the modulating signal of the signalling circuit is in the correct condition as to frequency and duty cycle, it checks whether the signal $Fo[M|i_1+i_2|]$ is other than zero, it checks the values of signals $Fo[|i_1-i_2|]$ and $Fo[|i_1+i_2|]$.

The results of the checks effected by the check circuit 9 are fed to a logic circuit 10 associated to a switching circuit 11, the latter receiving also the signal $i_1-i_2$ from the output 103 of circuit 3, the signal $i_1+i_2$ from the output 203 of said circuit 3, and the signal $$(i_1+i_2)\frac{Fo[M|i_1-i_2|]}{Fo[M|i_1+i_2|]}$$

from the output of the function generator circuit 8. The logic circuit 10 determines—depending upon the result of the checks effected by the circuits 9—which one of the three signals fed to the switching circuit and corresponding to the expressions (1), (2), (3) is to be regarded as the correct expression of the unbalance $\Delta i$ between the two fractions of the return electrical traction current in the two rails. Depending upon the decision of the logic circuit 10, the switching circuit 11 is switched over to one of said three received signals and emits the respective $\Delta i$ signal at the output thereof. More specifically, one of the three following cases may occur:

(1) The $\Delta i$ signal at the output of the switching circuit 11 corresponds to $$(i_1+i_2)\frac{Fo[M|i_1-i_2|]}{Fo[M|i_1+i_2|]}$$

when $Fo[M|i_1+i_2|]\neq 0$.

(2) The $\Delta i$ signal at the output of the switching circuit 11 corresponds to the difference $i_1-i_2$, when either (or both) of the following conditions is complied with:

the modulating signal of the signalling current from the circuit 4 is not in the correct condition as to frequency and duty cycle;

the signal $Fo[M|i_1+i_2|]$ is absent (zero) and $Fo[|i_1+i_2|]>Fo[|i_1-i_2|]$.

(3) The $\Delta i$ signal at the output of the switching circuit corresponds to the sum $i_1+i_2$ when the signal $Fo[M|i_1+i_2|]$ is absent (zero) and $Fo[|i_1+i_2|]<<Fo[|i_1-i_2|]$.

The $\Delta i$ signal at the output of the switching circuit 11 is applied to a final checking or comparing circuit 12 which compares the received $\Delta i$ signal to a pre-established reference value K, discerning either of the two following possible conditions:

(I) $\Delta i>K$. In this case, the unbalance $\Delta i$ detected by the device of the invention between the two fractions of return traction current in the two track rails is to be regarded as excessive, and the output signal of the comparing circuit 12 shifts to a corresponding logic level.

(II) $\Delta i<K$. In this case, the unbalance $\Delta i$ between the two fractions of return traction current in the two rails is not to be regarded as excessive and the output signal of the comparing circuit 12 assumes a corresponding logic level which is different from the previous level.

Of course, the various circuits shown by individual blocks in the drawing may be constructed in any suitable manner to fulfil their functions, as obvious to those skilled in the art.

What I claim is:

1. A device for detecting the unbalance $\Delta i$ between two fractions of the return traction current which flow in the two rails of a railroad track, in the presence of a signalling current in the respective track circuit, comprising: a linear combination circuit (3) which receives the two currents ($i_1$ and $i_2$) actually existing in the two rails and generates both the difference $(i_1-i_2)$ and the sum $(i_1+i_2)$; a demodulating circuit (4) which is fed with the signal of the difference $(i_1-i_2)$ and which takes from it the modulating signal of the signalling current; a sample generator circuit (5) which receives the modulating signal of the signalling current and generates a sample function M(t); two sampling circuits (106 and 206) which receive the sample function, one of which (106) also receives the difference signal $(i_1-i_2)$ and supplies the difference sampled signal $M(i_1-i_2)$, while the other (206) also receives the sum signal $(i_1+i_2)$ and supplies the sum sampled signal $M(i_1+i_2)$; four rectifying-filtering circuits (107,207,307,407) which receive the difference signals $(i_1-i_2)$, the sampled difference $M(i_1-i_2)$, the sum $(i_1+i_2)$ and the sampled sum $M(i_1-i_2)$ and supply the mean values of the respective rectified signals $Fo[|i_1-i_2|]$, $Fo[M|i_1-i_2|]$, $Fo[|i_1+i_2|]$ and $Fo[M|i_1+i_2|]$; a function generator circuit (8) which is fed with the signals $(i_1+i_2)$, $Fo[M|i_1-i_2|]$ and $Fo[M|i_1+i_2|]$ and supplies a signal corresponding to $$(i_1 + i_2)\frac{Fo[M|i_1 - i_2|]}{Fo[M|i_1 + i_2|]};$$

a switching circuit (11) that receives the signal supplied by the function generator circuit, the difference signals $(i_1-i_2)$ and the sum signals $(i_1+i_2)$; and means including a check circuit (9) and a logic circuit (10) for controlling the switching circuit so that it emits at its output, as a $\Delta i$ signal corresponding to the unbalance between the two fractions of the return traction current in the two rails, depending upon certain conditions, one of the received signals $$(i_1 + i_2)\frac{Fo[M|i_1 - i_2|]}{Fo[M|i_1 + i_2|]} \text{ or } (i_1 - i_2) \text{ or } (i_1 + i_2).$$

2. A device according to claim 1, wherein said check circuit (9) comprises means for checking whether the modulating signal of the signalling current is in the correct condition and whether the signal $Fo[M|i_1+i_2|]$ is other than zero while it determines the value of signals $Fo[|i_1-i_2|]$ and $Fo[|i_1+i_2|]$ and feeds the logic circuit (10) which switches the output of the switching circuit (11) to the signal $$(i_1 + i_2)\frac{Fo[M|i_1 - i_2|]}{Fo[M|i_1 + i_2|]}$$

when $Fo[M|i_1+i_2|]$ is other than zero, or to the signal $(i_1-i_2)$ when the modulating signal of the signalling current is not in a correct condition and/or when the signal $Fo[M|i_1+i_2|]$ is zero and $Fo[|i_1+i_2|]>Fo[|i_1-i_2|]$, or to the signal $(i_1+i_2)$ when the signal $Fo[M|i_1+i_2|]$ is zero and $Fo[|i_1+i_2|]<Fo[|i_1-i_2|]$.

3. A device according to claim 1, further comprising a final checking circuit (12) which compares the $\Delta i$ signal at the output of the switching circuit (11) with a pre-established reference value and which emits two different logic signals depending upon whether the unbalance $\Delta i$ signal between the two fractions of the return traction current in the two rails is lower or higher than the pre-established reference value.

4. A device according to claim 2, further comprising a final checking circuit which compares the $\Delta i$ signal at the output of the switching circuit (11) with a pre-established reference value and which emits two different logic signals depending upon whether the unbalance $\Delta i$ signal between the two fractions of the return traction current in the two rails is lower or higher than the pre-established reference value.

* * * * *